US008950610B2

(12) United States Patent
Schellenbach et al.

(10) Patent No.: US 8,950,610 B2
(45) Date of Patent: Feb. 10, 2015

(54) CLOSURE

(76) Inventors: Frank Schellenbach, Maranoivalp (IT); Philip Schellenbach, Schwyz (CH); Fabian Schellenbach, Schwyz (CH)

( * ) Notice: Subject to any disclaimer, the term of this patent is extended or adjusted under 35 U.S.C. 154(b) by 663 days.

(21) Appl. No.: 12/443,977

(22) PCT Filed: Aug. 31, 2007

(86) PCT No.: PCT/EP2007/059150
§ 371 (c)(1),
(2), (4) Date: Nov. 15, 2009

(87) PCT Pub. No.: WO2008/040602
PCT Pub. Date: Apr. 10, 2008

(65) Prior Publication Data
US 2011/0139746 A1 Jun. 16, 2011

(30) Foreign Application Priority Data
Oct. 2, 2006 (DE) ..... 10 2006 047 023

(51) Int. Cl.
*B65D 53/00* (2006.01)
*B65D 41/04* (2006.01)

(52) U.S. Cl.
CPC ..... *B65D 41/0421* (2013.01)
USPC ..... 215/344; 215/341

(58) Field of Classification Search
USPC ..... 215/341, 352, 329, 344, DIG. 1, 343
See application file for complete search history.

(56) References Cited

U.S. PATENT DOCUMENTS

| | | | | |
|---|---|---|---|---|
| 4,090,631 | A | 5/1978 | Grussen | |
| 4,125,201 | A * | 11/1978 | Birch | 215/330 |
| 4,540,102 | A * | 9/1985 | Wiedmer | 215/344 |
| 5,275,287 | A | 1/1994 | Thompson | |
| 5,743,420 | A * | 4/1998 | Loffler et al. | 215/270 |
| 2004/0129668 | A1 * | 7/2004 | Rossi | 215/344 |
| 2006/0138073 | A1 * | 6/2006 | Ooka et al. | 215/344 |

FOREIGN PATENT DOCUMENTS

| | | | |
|---|---|---|---|
| CN | 1134136 | A | 10/1996 |
| DE | 102004003372 | A1 | 5/2005 |
| EP | 0109631 | A | 5/1984 |
| EP | 0146011 | A | 6/1985 |
| EP | 1216930 | A | 6/2002 |
| EP | 1266838 | A | 12/2002 |
| FR | 1485328 | A | 6/1967 |
| FR | 2863589 | A1 | 6/2005 |
| WO | 9944896 | A2 | 9/1999 |

* cited by examiner

*Primary Examiner* — Jeffrey Allen
(74) *Attorney, Agent, or Firm* — Pai Patent & Trademark Law Firm; Chao-Chang David Pai

(57) ABSTRACT

A closure 1 for closing a container comprises a closure body, which has a front wall 3, a side wall 2 and a transition portion 4 between the front wall 3 and the side wall 2. An annular projection 8, extending from the front wall 3, is provided for contact on the top side 10*a* of the mouth piece 10 of the container. An outer seal 9 is formed as a tongue 9 which extends from the side wall 2 and/or from the transition portion 4 towards a central axis A of the closure 1. The tongue 9 rests flexibly against the contour of the outer edge 10*b* and/or outside 10*c* of the mouth piece 10 when the closure 1 is attached to the mouth piece 10 of the container.

14 Claims, 2 Drawing Sheets

CLOSURE

TECHNICAL AREA

The application relates to a closure for closing a mouth piece of a container, particularly for closing the mouth piece of a bottle, comprising

- a closure body, which has a front wall, a side wall, a transition portion between the front wall and the side wall and a central axis,
- at least one annular projection which extends from the front wall for the purpose of cooperating with the top side of the mouth piece to perform a sealing function, and
- at least one outer seal formed as a tongue, said seal extending from the side wall and/or from the transition portion to the central axis of the closure body, with the tongue having a sealing surface for making contact with the mouth piece.

PRIOR ART

From the prior art are known plastic caps for closing containers, particularly bottles, for example, plastic bottles (e.g. PET bottles).

An important component of the caps is the seal. Its primary purpose is to provide secure sealing but, on the other hand, it must not significantly impede easy opening and closing of the container. This is to be seen not only from the aspect of comfortable handling by the consumer, but also from the aspect of minimizing the effort required for mechanical closing of the bottles after they have been filled and eliminating downtimes.

Known, conventional sealing concepts are listed, for example, in WO 1999/44896 A2. The seals described therein especially feature various configurations of bead-like or wedge-shaped sealing lips, the free ends of which make contact with the bottle neck in the closed state. In one embodiment, one of the sealing lips is formed like an elongated tongue and, jammed between the front wall of the closure and the top side of the mouth piece of the bottle, makes contact under high force with virtually the entire top side of the bottle neck. In order that problems caused by the high contact pressure and the large contact area may be avoided when the bottle is being opened and closed, lubricants (slip agents), such as behenamide and erucamide are added to the plastic material (e.g. PP, PE, PET) of which the monolithic cap is composed.

In this way, opening and, in particular, mechanical closing of the bottles is made easier, to be sure. The added additives have the property of migrating to the surface, of lowering surface tension in the case of carbonated beverages and of releasing carbon dioxide in the form of gushing. Moreover, there are concerns about the effects of known additives on consumer health.

Proceeding therefrom, the addition of additives which act as lubricants should increasingly be eschewed. It is to be assumed that these additives will be prohibited in the near future by lawmakers. However, this measure leads to the above-mentioned problems in the case of conventional sealing concepts, especially in respect of opening and closing of the closures.

In addition, rising raw materials prices and heightened environmental awareness (disposal of caps) have meant that less and less material is being used for the caps. However, for one thing, this requires the development of sealing concepts, in which the sealing components make do with less material. For another, it must be ensured that caps which are less robust because they are made with less material can be easily opened and closed. The weaker the structure of a cap as a whole, the more difficult it is to provide caps which may be easy to open and close yet still provide the customary reliable sealing function.

Patent DE 4425675 A1 shows a cap with a long, inwardly extending outer sealing lip, which is pressed between the top side of the bottle neck and the front wall of the cap at the end of the closing process. High friction forces are generated here.

Patent EP 1 117 596 B1 shows a series of sealing concepts for bottle closures. Provision is made for either a long outer seal, which is pressed against the face of the cap during closing. Or, provision is made for a relatively short tongue, which is formed and dimensioned such that, in the screwed-on state, its tip rests under tension against the front surface of the bottle mouth.

Technical Object

Proceeding therefrom, it is the object of the present invention to provide a plastic cap, which can be made with reduced material consumption, ensures a safe and reliable sealing function, and can be readily opened and closed without the addition of lubricants to the plastic material.

Technical Solution

This object is achieved with the provision of a closure in accordance with claim 1. Advantageous embodiments are the object of the dependent claims.

The inventive closure for closing a mouth piece of a container, particularly for sealing the mouth piece of a bottle, comprises

- A closure device, which features a front wall, a side wall, a transition portion between the front wall and the side wall and a central axis, and
- At least one outer seal formed as a tongue, said seal extending from the side wall and/or from the transition portion to the central axis of the closure body, with the tongue having a sealing surface for making contact with the mouth piece. The tongue is flexible and formed such that the sealing surface makes full contact (surface-to-surface contact) with the contour of the outside and/or the outer edge and/or the top side of the mouth piece when the closure is being attached to the mouth piece of the container.

In the present invention, the outer seal is formed in a special way, namely as a tongue or lip, which, when the closure is being attached to the container opening of a bottle, rests against the outside and/or outer edge and/or top side of the bottle neck, without exerting significant pressure on the bottle during the opening or closing operation. However, in the closed state, there is no contact between the outer seal and the top side of the bottle neck, or only a small proportion of the top side of the bottle neck is contacted by the outer seal. In the closed position, the tongue, whether with or without intended external force and deformation, is never in contact with the projection (at least, not with the uppermost projection). That is, the projection rests directly on the top side of the mouth piece. There is always a space between the free end of the tongue and the projection, especially after the bottle has been closed. An air chamber is thus created between the projection and the tongue. The air chamber allows for simpler compliance with tolerances (for example, the usual dimensional deviations for a PET bottle of 1/10-2/10 mm from the set value). In other words, the air chamber cancels out deviations, since the position of the tongue along the surface of the mouth piece is not critical, and the tongue rests relatively freely on the mouth piece.

While in the case of conventional closures, a structure extending from the front wall presses the tongue against the top side of the bottle neck during the closing process, in the present invention, the free end of the tongue is relatively loose in the closed position, i.e. not under any force exerted directly from the top side of the mouth piece, in a gap between the top side of the mouth piece and the front wall. The total frictional resistance which the tongue exerts on the mouth piece is due to elastic bending of the tongue (combined with full-surface contact of the tongue) and not, as in the prior art, to pinching of the tongue between the top side of the mouth piece and the front wall of the cap. Instead, in the closed state, the free end of the tongue lies relatively free between the aforementioned components. The tongue supports itself by its free end against the front wall. In this position, the sealing surface is bent slightly elastically by the force exerted by the outer edge of the mouth piece. In this way, secure closure is accomplished. Furthermore, the inventive outer seal is not substantially pre-tensioned, so that a contact surface can actually be formed between the bottle neck and the tongue.

Another function of the gap between the tongue and the projection in the closed position is to provide room for the tongue to move along the surface of the mouth piece. In the case of deformation of the cap by a change in the internal pressure in the bottle mouth, for example, the tongue can move along the surface and move in the gap while making full-surface contact with the surface of the mouth piece, so that jamming and tensioning of the tongue due to a change in conditions is prevented. The tongue can, in principle, move towards or away from the projection without, in the closed position, ever being in contact with the projection.

The stop of the closure during closing is therefore determined solely by the projection, which makes direct contact with the top side of the mouth piece during closing.

This distinguishes the seal from conventional seals, which exert a substantial resistance and thus high friction when the bottle is being opened and closed, especially when plastic bottles, for example, PET bottles, are being opened and closed. For one thing, the hitherto use of lubricants in the cap material meant that forming long outer seals with large contact areas, which practically make contact with the entire top side of the bottle mouth under large contact pressure, was not problematic. Although the large contact area makes for a particularly reliable seal, it also leads in conventional designs to high friction when the closure is being opened and closed, particularly in the case of certain material compositions.

For another, the tongue is inventively formed so as to be relatively thin and flexible. The sealing surface is formed at least as a partial surface of the longitudinally extending (especially directed downwards towards the mouth) outer surface of the tongue. It adapts flexibly and across its full face to the surface and the contour of the surface of the mouth piece or rests against it. One could also say that the outer seal makes a form-fit connection with the bottleneck. The resistance is reduced, however, by the low thickness of the tongue and the resultant flexibility (compared with a conventional highly-pronounced tongue), such that mechanical closing of the bottle especially can be performed easily.

In conventional sealing concepts, on the other hand, known wedge seals have less elastic deformability because of their greater thickness and therefore exert greater resistance and greater friction when the bottle is being opened and closed (assuming equally large sealing surface).

Due to the low contact force exerted by the outer sealing lip on the bottle neck, the present invention affords comfortable opening and closing of the bottle even without lubricant. Conversely, this means that a larger contact area (and a better seal) can be realized without a substantial increase in friction during opening and closing.

Moreover, the shorter and thinner outer sealing lip saves on plastic material. The seal is also used for closure caps of thinner wall thickness, since the seal is easy to open and close in the case of caps which are less stable (and thus more sensitive to high internal stresses).

In a preferred embodiment, the tongue does not exceed a thickness (d) of 6/10 mm along its length.

Moreover, as a person skilled in the art would understand, the thickness is determined for the region of the tongue extending from its base to its tip, i.e. in the region in which both the top side and the underside of the tongue, essentially in the longitudinal direction of the tongue, run freely. The thickness is essentially determined perpendicularly to the direction of direction.

The thickness of the tongue decreases continuously towards its free end, preferably in the direction of its extension The tongue can have a thickness (d) of between 0.15 mm and 0.60 mm at its starting point. Roughly in the middle of the tongue, the thickness is 0.05 mm to 0.4 mm.

The tongue preferably has a maximum length of less than 2.50 mm, particularly 2.25, particularly 2.1 mm. The minimum length of the tongue is 1.75 mm, especially 2.00 mm.

In a preferred embodiment, the closure has at least one projection, extending from the front wall, for cooperating with the top side of the mouth piece for the purpose of fulfilling a sealing and/or stop function. The tongue is of a length such that it is not in contact with the projection(s) when the closure has been attached to the mouth piece. The projection can be either annularly closed or be segmented (stop function). The projection can, however, also be supplemented with or replaced by other stops.

The distance between the inside of the side wall and the projection is preferably greater than the distance between the inside of the side wall and the free end of the tongue.

The projections can be arranged as annular shoulders, sealing lips and the like on the inside of the lid part or the front wall. They extend down from the front wall towards the mouth. By virtue of the spacing of the free end of the tongue, there is always a gap between the free end of the tongue and the, with respect to the tongue, inwardly radially offset projection. A gap exists at least in so far that the projection (or at least one of the projections) does not cooperate with the tongue or exert a force on it. Rather, when the bottle is closed, the projection is in direct contact with the bottle neck.

The tongue extends essentially parallel to the front wall, especially in the absence of external forces. This applies especially to the underside of the tongue, which, when the bottle is being closed, rests flexibly against, for example, the outer wall of the bottle mouth.

The closure is preferably formed as a screw closure with an internal thread.

The closure comprises in particular a plastic, particularly polypropylene, polyethylene, polyethylene terephthalate. The closure can consist of the corresponding plastic or a mixture of these or other commonly used plastics.

Preferably, no additives are added to the plastic that act as lubricant, slip agent or have a lubricant effect. The seal is especially suited to this specific application, since its design reduces frictional force when a bottle is being opened or closed, and hence there is no need to use lubricants in the cap material. For example, the flexible resting of the tongue on the outside of the bottle does not generate pressure between the top side of the bottle mouth and the tongue, as is the case for similar known closures.

The closure can be formed as one piece.

The closure can have at least one inner seal, which is formed so as to make contact with the inside of the mouth piece of a container. In particular, the outside of this inner seal has a projection which makes contact with the bottle neck during closing. In this connection, the inner seal is rotated inwardly in an elastic manner. In the region of the free end, starting from the projection, the inner seal tapers continuously.

The closure is preferably made by injection moulding.

The tongue is formed so as to be particularly flexible and such that, when the closure is attached to the mouth piece of the container, the sealing surface makes full-surface contact with the contour of the outside and/or the outer edge of the mouth piece, and the free end of the tongue above the mouth piece extends radially towards the central axis of the closure between the top side of the mouth piece and the front wall of the closure. The tongue makes contact with the front wall and the outside and/or the outer edge of the mouth piece, but is still basically arranged so as to be freely movable.

In a preferred embodiment, in the closed state, the free end of the tongue can move relatively freely between the top side of the mouth piece and the front wall of the closure. It therefore protrudes radially inwards into the gap formed between the front wall and the top side of the bottle mouth. Contact with the bottle mouth and the front wall of the cap is effected solely by virtue of the flexibility and the position of the tongue. In contrast, pinching of the tongue between the front wall and the bottle mouth is avoided or prevented by the design of the closure. The tongue receives its closed position solely by virtue of the position into which it has been brought in the closed state, and of its flexibility.

Preferably, the free end of the tongue extends with relatively free mobility between the top side of the mouth piece and the front wall of the closure.

In another embodiment, the tongue is formed so as to be flexible and such that, when the closure is being attached to the mouth piece of the container, the sealing surface makes full-surface contact with the contour of the outside (and/or the outer edge of the mouth piece), and the free end of the tongue extends upwards, essentially perpendicularly in the direction of the front wall. The tongue is therefore pressed upwards by the bottle mouth, and makes practically full-length contact with the bottle mouth. However, when the bottle has been completely closed (is in the closed state), the tongue can be arranged perpendicularly relative to the front wall, but can project over the bottle mouth and, in certain circumstances, also make slight contact with the front wall.

In particular, in the closed state, the free end of the tongue can also be arranged without making contact with the front wall.

For the above reasons, the inventive measures alone and in combination are particularly suited to solving the problems occurring in the prior art. Moreover, protection is also sought for a bottle closed with the inventive closure, especially a bottle of plastic, especially a PET bottle closed with the closure.

In addition, protection is also sought for the closing method also described in this application.

BRIEF DESCRIPTION OF FIGURES

Other features, characteristics and advantages of the invention arise from the following description of an embodiment in connection with the Figures. They show in FIG. 1 a cross-section of an inventive cap.

WAYS TO IMPLEMENT THE INVENTION

Figure 1:
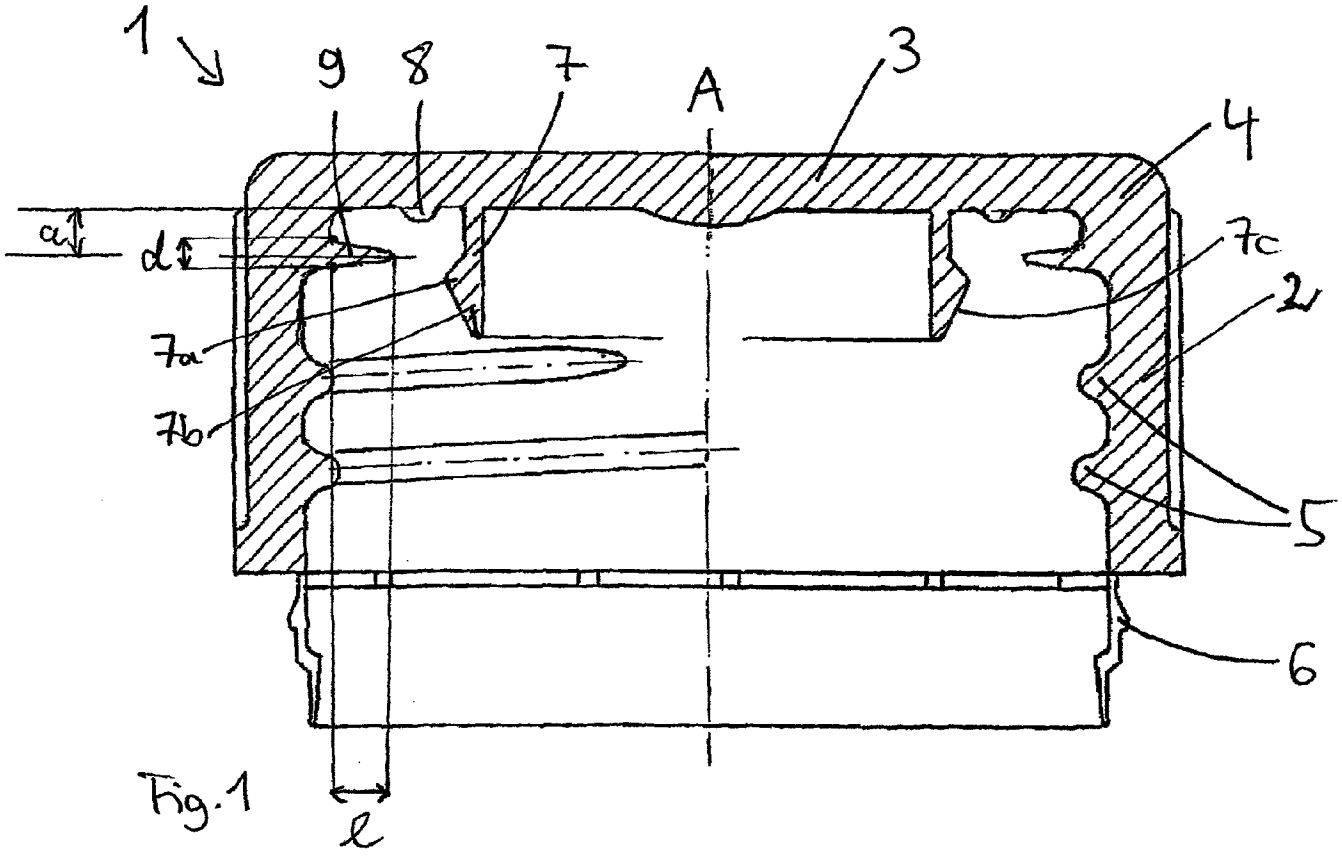

FIG. 1 shows an inventive cap 1, which is made in one piece from a known plastic material, such as polypropylene (PP), polyethylene (PE), polyethylene terephthalate (PET, PETP), and the like.

The body of the cap 1 has a side wall 2 and a front wall 3 connected via the transition portion 4. The transition portion 4 constitutes a connecting region between the side wall 2 and the front wall 3.

On the inside of the side wall 2 is an internal thread 5 for screwing on the cap 1 to a corresponding outer thread of a bottle neck or mouth piece of a container. Extending downwards from free end of the side wall 2 is a guarantee band 6, which acts a guarantee and safety function.

The sealing function is provided by sealing means 7, 8, 9.

The sealing means 7, 8, 9 consist of an inner seal 7, which is formed as a lamella which extends perpendicularly downwards from the front wall 3. Roughly in the middle of the outside of the inner seal 7 with respect to its direction of extension is a bead or projection 7*a*. Below the projection 7*a*, the lamella 7 tapers towards its free end 7*b*. The outer surface 7*c* of the inner seal 7 tapers inwardly like a funnel towards its free end in the direction of a central axis A.

Further, extending down from the front wall 3 is an annular projection 8.

Moreover, the sealing means 7, 8, 9 comprise an outer seal 9, which is in the form of a tongue or wedge-shaped lip. Close to transition portion 4 and starting from the side wall 2, it extends essentially parallel to the front wall 3 towards a central axis A of the closure 1. The outer seal 9 is moulded around the entire inside circumference of the side wall 2.

In accordance with the invention, the tongue 9 is formed so as to be relatively short, i.e. of low free length l. The free length l is dimensioned in any event such that, as soon as the tongue 9 is pressed from below towards or close to the front wall 3, it does not reach the annular projection 8 of the sealing means 7, 8, 9. The permissible length in the context of the invention depends of course also on the distance a between the front wall 3 and the free end of the tongue 9. A person skilled in the art knows in any case the length to choose for the tongue in conjunction with the other parameters, such that the tongue in the closed state does not reach the projection 8. The free length l can be, for example, 2.00 mm.

Moreover, the tongue 9 is formed so as to be very thin. For example, at its starting point, it has a thickness d of between 0.15 mm and 0.60 mm, which reduces continuously towards the free end to values of between 0.05 mm and 0.4 mm (e.g., approximately in the centre of the tongue).

The angle between the underside and the top side of the tongue 9 essentially determines the pressure exerted by the tongue 9 on the bottle neck during the closing process. This angle is chosen to be between 5° and 15° in the present invention in order that a suitable pressure may be generated during closing. The underside of the tongue 9 is essentially flat and extends—in the unclosed state—essentially parallel to the front wall of the cap.

Figure 2:
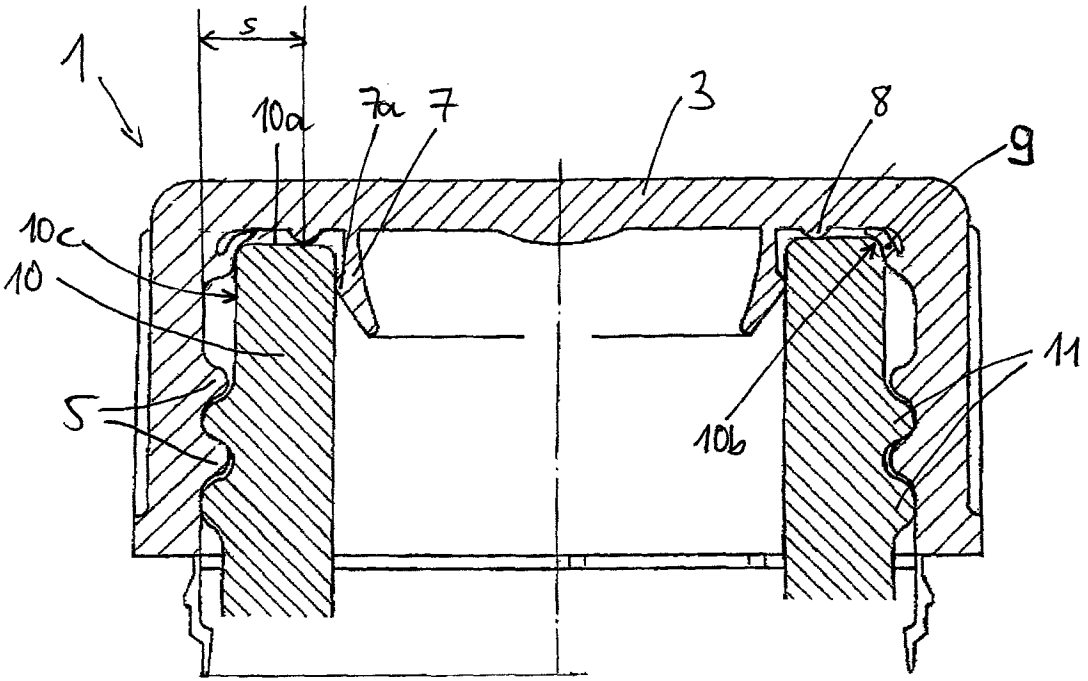
FIG. 2 a cross-section of the cap from FIG. 1, attached to a bottle mouth.

FIG. 2 shows the cap 1 from FIG. 1, wherein the cap 1, in a closed state, is attached to the mouth piece 10 of a container, such as a PET bottle. In the present case, the closure 1 is a screw closure with an internal thread 5, which is screwed onto a corresponding external thread 11 of the mouth piece 10.

The sealing means 7, 8, 9 seal off the inside of the container from the external environment. To this end, in the closed state, the bead or projection 7*a* of the inner seal 7 rests against the inside of the upper section of the mouth piece 10. Since the mouth piece 10 pushes or turns the inner seal 7 slightly outwards during the closing process, in the closed state, the projection 7*a* rests securely against the inside of the mouth piece 10.

In the closed state shown in FIG. 2, the annular projection 8 is in contact with the top side 10*a* of the mouth piece 10.

By virtue of its dimensions and flexibility, the tongue 9 of the outer seal is pushed upwards by the mouth piece 10 during the closing process, but exerts only a small resistance/pressure on the top side 10*a* or outer edge 10*b* of the mouth piece 10. It is especially formed to be flexible enough to make contact with an adequate area of the outer edge 10*b* of the mouth piece 10, while offering low resistance during the closing process. The tongue 9 can be bent flexibly and so its underside makes full contact with the bottle neck 10, i.e. the tongue 9 bends so readily along its entire length that—under the pressure exerted by the upper edge of the bottle neck during closing—it is practically flexibly deformed and moulds itself to the contour of the outer edge 10*b* and outside 10*c* of the mouth piece 10. The outcome is a low contact pressure; the tongue 9 makes contact about its radius.

Upon closer examination of FIG. 2, it becomes clear that, in the closed state, the tongue 9 does not rest at all on the mouth piece's 10 top side 10*a*, which is parallel to the front face 3, but rests relatively freely against the inside of the front wall 3 in the space between the top side 10*a* of the mouth piece 10 and the inside of the front wall 3. Pressure on the outer edge 10*b* for the purpose of ensuring the closing function is essentially ensured by elastic bending of the sealing lip 9 in its closed position.

In this way, it is possible, even without lubrication or slip agent in the cap 1 and/or in the mouth piece 10 of the container, to prevent jamming of the cap 1 on the container mouth 10 during opening of the container. Moreover, closing is simplified compared to caps with relatively long sealing lips, which exert high resistance and generate greater friction.

Along its length, as is also clear from FIG. 2, the tongue 9 extends in the closed state over a portion of the outer edge 10*b* of the mouth piece 10, but not over or (not shown) over only a small distance (as measured by the wall thickness of the mouth piece 10) along the top side 10*a* of the mouth piece 10. As a result of this, too, the friction arising during opening and closing of the bottle is controllable relative to caps having seals with a long lip, as known from the prior art. The tongue 9 can also be designed to preferably make contact along the outside 10*c* only of the mouth piece. The free end of the tongue does not necessarily protrude between the front side 3 and the top side of the bottle 10*a*. The free end of the tongue cannot in any way or only to a small degree point radially inwards over the top side 10*a* of the mouth piece 10 towards the front side 3, or projection 8, while the projection 8 acts as stop. It is also possible for the tongue to touch the front side only slightly or not at all, i.e. in the closed state, it ends underneath the outer edge 10*b* of the bottle mouth 10. With regard to fluctuations in the bottle diameter (i.e. radial), using the cap 1 affords a high degree of flexibility and imposes low demands on tolerances. The cap 1 can be used for different mouth diameters, depending on with the tongue projecting to a greater or lesser extent over the surface 10*a* or into the gap outside the projection 8.

To an extent depending on the specification, the tongue 9 can be of any length, but only of a length such that the tongue 9 does not reach the projection 8 in the closed state. In this way, between the free end of the tongue 9 and the projection 8 is formed a space in which is arranged the tongue 9, relatively freely positionable and resting against the surface 10*a*, 10*b*, 10*c* of the mouth piece 10. For one thing, this enables simpler compliance with tolerances in the design of the closure 1 and the corresponding bottle. Moreover, if the internal pressure rises and a force is exerted on the olive of the closure 1, bending of the cap and thus leverage forces occur. These can be compensated in the current inventive sealing concept by a movement of the tongue 9 along the surface of the mouth piece, whether it be along the outer surface 10*c*, the edge 10*b* and/or the upper surface 10*a*.

It is also clear from FIG. 2 that in the closed state a gap is formed between the transition portion 4 and the tongue 9. This gap, too, provides an opportunity to compensate for manufacturing tolerances (e.g. 1/10 mm) in the manufacture of the bottle mouth and the closure.

In the current case, the distance s between the inside of the side wall 2 and the projection 8 is greater than the distance between the inside of the side wall 2 and the free end of the tongue 9. Overall, in the closed state, a gap should remain between the annular projection 8 and the tongue 9, such that, in the closed state, a minimum possible contact resistance due to the sealing means 7, 8, 9 occurs between the cap 1 and the container mouth 10. The contact area between the tongue 9 and the container mouth 10 is reduced compared with the prior art, without abandonment of a full-surface contact area.

In addition, the tongue 9 has high flexibility in the closing direction, so that it can be moved towards the front side 3 without large mechanical resistance.

The sealing concept is also suitable for closures of reduced weight, i.e. made from less material, because the lower friction forces lead to a lower load on the closure during opening and closing.

The invention claimed is:

1. A closure (1) for closing a mouth piece (10) of a container, particularly for sealing the mouth piece (10) of a bottle, comprising:

a closure body, which comprises a front wall (3), a side wall (2), a transition portion (4) between the front wall (3) and the side wall (2), and a central axis (A);

at least one outer seal formed as a tongue (9), said tongue (9) extending from at least one of the side wall (2) and the transition portion (4) towards the central axis (A) of the closure body, wherein the tongue (9) extends essentially parallel to the front wall (3) in the absence of external forces and has a sealing surface for making contact with the mouth piece (10); and at least one annular projection (8), extending from the front wall (3), for cooperating with a top side (10*a*) of the mouth piece (10) for the purpose of fulfilling a sealing and stop function, wherein the tongue (9) is flexible and formed such that the sealing surface makes full contact with the contour of at least one of an outside (10*c*), an outer edge (10*b*) and the top side (10*a*) of the mouth piece (10) when the closure (1) is screwed fully to the mouth piece (10) of the container so that the top side of the mouth piece is in contact with the at least one annular projection (8), wherein the contact between the tongue and the outer edge and the top side, respectively, of the mouth piece is effected solely by virtue of flexibility and position of the tongue, without pinching of the tongue between the outer edge of the mouth piece and the transition portion of the closure body or between the top side of the mouth piece and the front wall of the closure body; and the tongue (9) has a length (1), such that it is not in contact with the at least one annular projection (8) and a free end of the tongue (9) extends upwards and towards the central axis (A) with free mobility between the top side (10*a*) of the mouth piece (10) and the front wall (3) of the closure body when the top side (10*a*) of the mouth piece (10) is stopped by the at least one annular projection (8) and the closure (1) is in a closed position screwed fully to the mouth piece (10).

2. The closure (1) in accordance with claim 1, wherein the tongue has a thickness (d) of between 0.15 mm and 0.60 mm where the tongue extends from at least one of the side wall (2) and the transition portion (4).

3. The closure (1) in accordance with claim 1, wherein the tongue (9) has a maximum thickness (d) of between 0.3/10 mm and 5/10 mm in the direction of extension of the tongue (9).

4. The closure (1) in accordance with claim 3, wherein the thickness (d) of the tongue (9) decreases continuously towards the free end of the tongue in the direction of extension of the tongue (9).

5. The closure (1) in accordance with claim 1, wherein the tongue (9) has a length (1) of less than 2.50 mm.

6. The closure (1) in accordance with claim 1, wherein the distance (s) between the side wall (2) and the at least one annular projection (8) is greater than the distance between the side wall (2) and the free end of the tongue (9).

7. The closure (1) in accordance with claim 1, wherein the closure (1) is formed with an internal thread (5) on an inside of the side wall (2).

8. The closure (1) in accordance with claim 1, wherein the closure comprises a plastic.

9. The closure (1) in accordance with claim 8, wherein the plastic contains no additives that act as lubricant or slip agent.

10. The closure (1) in accordance with claim 1, wherein the closure (1) is formed as one piece.

11. The closure (1) in accordance with claim 1, wherein the closure (1) has at least one inner seal (7), which is formed so as to make contact with an inside of the mouth piece (10) of a container.

12. The closure (1) in accordance with claim 8, wherein the closure (1) is made by injection moulding.

13. The closure (1) in accordance with claim 8, wherein the plastic is selected from the group consisting of polypropylene, polyethylene, and polyethylene terephthalate.

14. The closure (1) in accordance with claim 1, wherein a middle section of the tongue has a thickness between 0.05 mm and 0.4 mm.

* * * * *